US007802808B2

(12) United States Patent
Neiley

(10) Patent No.: US 7,802,808 B2
(45) Date of Patent: Sep. 28, 2010

(54) LOCKING ATTACHMENT AND ADJUSTMENT DEVICE

(75) Inventor: Roger Neiley, Laguna Beach, CA (US)

(73) Assignee: Goodwell International, Ltd., Tortola (VG)

( * ) Notice: Subject to any disclaimer, the term of this patent is extended or adjusted under 35 U.S.C. 154(b) by 540 days.

(21) Appl. No.: 11/691,420

(22) Filed: Mar. 26, 2007

(65) Prior Publication Data

US 2007/0246914 A1 Oct. 25, 2007

Related U.S. Application Data

(60) Provisional application No. 60/785,931, filed on Mar. 24, 2006.

(51) Int. Cl.
*A63C 9/24* (2006.01)

(52) U.S. Cl. ..... 280/623; 280/634

(58) Field of Classification Search ..... 280/611, 280/619, 624, 634, 11.36, 623, 625; 36/115, 36/117.9; 24/68 SK
See application file for complete search history.

(56) References Cited

U.S. PATENT DOCUMENTS

| | | | | |
|---|---|---|---|---|
| 3,662,435 | A | 5/1972 | Allsop | |
| 4,310,951 | A | 1/1982 | Riedel | |
| 4,453,290 | A | 6/1984 | Riedel | |
| 4,631,839 | A | 12/1986 | Bonetti et al. | |
| 5,172,454 | A | 12/1992 | Martignago | |
| 5,416,952 | A | 5/1995 | Dodge | |
| 5,530,997 | A | 7/1996 | Tessari | |
| 5,745,959 | A | 5/1998 | Dodge | |
| 5,745,963 | A | 5/1998 | Graziano | |
| 5,887,318 | A | 3/1999 | Nicoletti | |
| 5,918,897 | A | 7/1999 | Hansen et al. | |
| 5,971,423 | A * | 10/1999 | Hansen et al. | 280/634 |
| 6,175,994 | B1 | 1/2001 | Nicoletti | |
| 6,250,651 | B1 | 6/2001 | Reuss et al. | |
| 6,267,390 | B1 | 7/2001 | Maravetz et al. | |
| 6,292,983 | B1 | 9/2001 | Giaquinta et al. | |
| 6,412,794 | B1 | 7/2002 | Phillips et al. | |
| 6,416,074 | B1 | 7/2002 | Maravetz et al. | |
| 6,416,075 | B1 | 7/2002 | Laughlin et al. | |
| 6,547,218 | B2 | 4/2003 | Landy | |
| 6,679,516 | B2 * | 1/2004 | Andrevon | 280/623 |
| 6,705,633 | B2 | 3/2004 | Poscich | |
| 6,722,688 | B2 | 4/2004 | Poscich | |
| 6,726,238 | B2 | 4/2004 | Poscich | |
| 6,748,630 | B2 | 6/2004 | Livingston | |
| 6,773,020 | B2 | 8/2004 | Gonthier | |
| 6,938,913 | B2 | 9/2005 | Elkington | |
| 6,974,149 | B2 | 12/2005 | Naito et al. | |
| 7,036,830 | B2 * | 5/2006 | Gonthier | 280/14.21 |
| 7,232,132 | B2 | 6/2007 | Elkington | |
| 7,232,147 | B2 * | 6/2007 | Couderc | 280/623 |
| 2004/0211039 | A1 | 10/2004 | Livingston | |
| 2007/0158929 | A1 | 7/2007 | Neiley et al. | |

* cited by examiner

*Primary Examiner*—Frank B Vanaman
(74) *Attorney, Agent, or Firm*—Fred C. Hernandez; Mintz, Levin, Cohn, Ferris, Glovsky, Popeo, P.C.

(57) ABSTRACT

A binding is used for coupling a boot to a sport board. The binding includes a base plate, an instep support, and at least one fixation strap that couples the base plate to the instep support. An adjustment mechanism such as a buckle actuates to move the instep support toward the base plate. The adjustment mechanism can be transitioned into a first locked position wherein the instep support is prevented from moving toward the base plate.

9 Claims, 6 Drawing Sheets

LOCKING ATTACHMENT AND ADJUSTMENT DEVICE

REFERENCE TO PRIORITY DOCUMENT

This application claims priority of co-pending U.S. Provisional Patent Application Ser. No. 60/785,931 filed Mar. 24, 2006. Priority of the aforementioned filing date is hereby claimed and the disclosure of the Provisional Patent Application is hereby incorporated by reference in its entirety.

BACKGROUND

Disclosed is a ratcheting attachment and adjustment mechanism for coupling together two objects, such as for example a snowboard boot to a binding. Although described herein in the context of a snowboard binding for use with a snowboard, it should be appreciated that the mechanism described herein can be used with other types of sports equipment. For example, the mechanism can be configured for use with a wakeboard, kiteboard, or any other appliance to which footwear or other objects are coupled.

Sports such as snowboarding demand tight and secure binding of the boots to the snowboard to assure precision control of the snowboard. A snowboarder's boot is secured to the snowboard in a binding, which unlike ski bindings, generally will not release the boot during a fall.

It is generally desirable that the binding hold the boot securely enough that the boot cannot inadvertently slip out of the binding, even if the snowboarder falls during a run. However, it is desirable to release the boot for freedom of movement before and after downhill rides, for example, when riding a ski lift. Therefore, it is desirable to have a binding that allows easy entry and exit by the boots as well as tight and secure binding of the boot to the board.

Attachment mechanisms for snowboard bindings frequently include adjustment devices that provide some mechanical advantage to facilitate instep member tightening. For example, a ratchet-type buckle can be adjustably coupled to a binding element, such as a strap that can be attached at one end to a frame of the binding. The strap (often referred to as a ladder strap) typically has a plurality of transverse ridges, or teeth that adjustably engage the buckle.

In use, the ladder strap is inserted into the buckle body and a lever on the buckle is pivoted to engage the strap teeth and advance the buckle body along the ladder strap. A separate holding device (i.e., a pawl) is provided to engage the strap teeth. A pawl prevents backward movement of the buckle body or loosening as the lever is lifted away from the strap. This allows for re-engagement of the strap for further tightening of the instep member without inadvertent loosening from the starting position.

SUMMARY

Although prevention of inadvertent loosening of the instep member is desirable, it can also be desirable to prevent inadvertent tightening of the instep member. For example, when the binding includes a reclining highback, repeated entry can pose a risk for the user to accidentally tighten an instep member that has been previously adjusted to a desired fit and tension.

There remains a need for an adjustment mechanism for use with an instep member (such as in combination with a ladder-type strap) that is easily releasable and prevents inadvertent tightening as well as inadvertent loosening of the instep. Further, there is a need for an adjustment mechanism for use with attachment mechanisms such that fine-tuning of instep tightness is adjusted once and maintained during each entry and exit of the boot in the binding.

In one aspect, there is disclosed a binding for coupling a boot to a sport board, comprising: a base plate; an instep support; at least one fixation strap that couples the base plate to the instep support; and an adjustment mechanism wherein the adjustment mechanism actuates to move the instep support toward the base plate, and wherein the adjustment mechanism can be transitioned into a first locked position wherein the instep support is prevented from moving toward the base plate.

In another aspect, there is disclosed a binding for coupling a boot to a sport board, comprising: a base plate; an instep support; at least one fixation strap that couples the base plate to the instep support; and an adjustment mechanism adapted to adjust a position of the instep support relative to the fixation strap, wherein the adjustment mechanism prevents the position of instep support from being moved toward the base plate unless the adjustment mechanism is in an unlocked state.

Other features and advantages should be apparent from the following description of various embodiments, which illustrate, by way of example, the principles of the invention.

DETAILED DESCRIPTION

Figure 1:
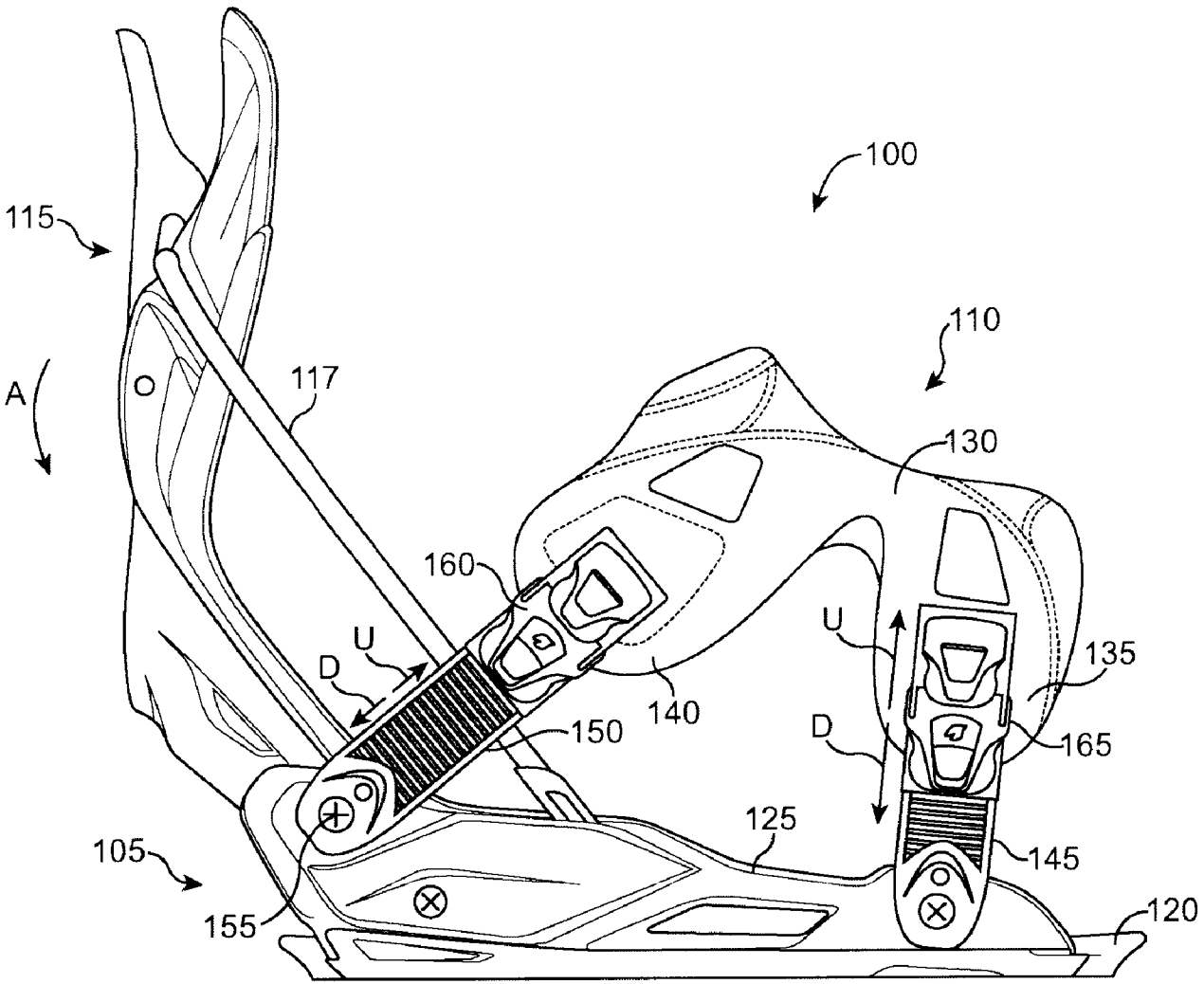
FIG. 1 shows a side view of a binding with an exemplary adjustment mechanism.

FIG. 1 shows a lateral side view of an exemplary snowboard binding 100. The binding 100 generally includes a chassis 105, an instep member 110, and a heel member comprised of a highback 115 that extends upwardly from the chassis 105. In an exemplary embodiment, a connection member 117 connects the highback 115 to the chassis 105. The instep member 110 includes an instep support 130 that is sized and shaped to fit over an instep region of a snowboard boot that is positioned on the binding. In an embodiment, the instep support 130 is attached to a base of the binding via one or more straps, such as a front strap 145 and rear strap 150. Adjustment mechanisms 160 and 165 adjustably attach the instep support 130 to the straps 150 and 145, respectively. The adjustment mechanisms can be attached to the front and rear straps or can alternately be attached to the instep support or a portion of the baseplate. In an alternate embodiment, the front and rear straps are seamlessly incorporated into at least one of the instep support 130 or the base of the binding.

As described in detail below, the adjustment mechanisms 160, 165 can be used to adjust the position of the instep support 130 to vary the tightness of the instep support 130 on a boot, such as to achieve a tighter or looser fit. The adjustment mechanisms can be used to move the instep support 130 downward (as represented by arrows D in FIG. 1) toward the base, such as along the straps to tighten the instep support onto a boot. The adjustment mechanism can also be used to move the instep support 130 upward (as represented by arrows U) or away from the base to loosen the instep support. Advantageously, the adjustment mechanisms can be moved into a locked position wherein the instep support is prevented from moving either upward or downward along the strap to thereby lock the instep support at a desired level of tightness. In addition, an actuator member on the adjustment mechanism can be used to incrementally tighten the instep support and to also unlock the adjustment mechanism such that the instep support can be freely moved in either direction along the straps. Various exemplary embodiments of the adjustment mechanisms are described herein, although it should be appreciated that this disclosure is not limited to the specific embodiments.

With reference still to FIG. 1, the chassis 105 includes a base 120 having a size and shape that are configured to attach to the surface of a snowboard, such as, for example, using screws. The base 120 can have a plate-like configuration with a contour that complements a contour of an upper surface of the snowboard. The chassis 105 also includes a pair of side members 125 that are positioned on opposite lateral sides of the base 120. The side members 125 extend upwardly from the base 120 and are positioned on opposite sides of a snowboard boot when the boot is positioned in the binding 100. Terms such as "upper," "lower," "vertical," "horizontal," and the like are made with reference to the figures and are not intended to limit the disclosed apparatus, which may be disposed in any convenient orientation.

With reference again to FIG. 1, the instep member 110 includes an instep support 130 that is sized and shaped to fit over the instep region of the snowboard boot. In this regard, the instep support 130 can be sized and shaped to conform to the instep region of the boot. For example, the instep support 130 can have a concave shape that fits around the instep region of the boot. In the exemplary embodiment shown in FIG. 1, the instep support 130 has an enlarged front region 135 and an enlarged rear region 140 interconnected by a smaller central region. It should be appreciated that the instep support 130 can have any of a variety of shapes that are configured to provide support to the instep or other regions of a boot, and may itself be adjustable fit various boot configurations and/or provide varying degrees of support and load transmission from the user to the snowboard.

As discussed, the instep member 110 includes one or more attachment members, such as straps (including a front strap 145 and a rear strap 150), that connect one side of the instep support 130 to a side member 125. FIG. 1 shows only the lateral side of the binding 100. It should be appreciated that the opposite side (the medial side) includes a corresponding pair of straps that connect a side member 125 on the medial side of the binding 100. The front strap 145 connects at one end to the front region 135 of the instep support 130 and at an opposite end to a frontward region of the side member 125 of the chassis 105. The rear strap 150 connects at one end to the rear region 140 and at an opposite end to a rearward region of the side member 125. It should be appreciated that the binding may or may not be symmetrical about its longitudinal axis. A primary attachment location 155 between the highback 115 and the chassis 105 is also an attachment location for the rear strap 150 in the embodiment of FIG. 1, although it should be appreciated that the highback 115 and the rear strap 150 can be attached to the chassis 105 at different locations.

As discussed, the front strap 145 and/or the rear strap 150 includes an adjustment mechanism (165 and 160, respectively), such as, for example, a buckle, that permits adjustment of the position of the instep support 130 toward or away from the base, such as by moving along the straps 145, 150. Although described herein as moving along the straps, it should be appreciated that other means of moving the instep support can be used. The adjustment mechanisms 165, 160 can also permit one or both of the straps 145, 150 to disengage from the instep support 130. When disengaged from the straps 145 and 150, the instep support 130 can be moved aside to permit a user to move a snowboard boot downwardly into the binding 100. As mentioned, other straps are also located on the medial side of the binding 100 (opposite to the side shown in FIG. 1.) The straps on the medial side can also include adjustment mechanisms that permit the instep support 130 to be completely removed from the binding 100. Alternately, only the set of straps on one side of the binding 100 has an adjustment mechanism, such that the opposite set of straps retain the instep support 130 to the binding when one set is disengaged.

In another embodiment, the straps 145, 150 do not disengage from the instep support 130 so that the instep support 130 is fixed to the binding 100, such as described in one embodiment of the snowboard binding shown in U.S. Pat. No. 5,918,897, which is incorporated herein by reference in its entirety. Such a fixed instep support 130 is well-suited for use in a snowboard binding where the highback 115 is configured to recline backward, as described below.

In one embodiment, the highback 115 is movable between the upright position (as shown in FIG. 1) and a reclined position wherein the highback 115 has rotated downward, such as along the direction of the arrow A in FIG. 1. The highback 115 rotates about a predetermined location, such as about the attachment location 155. When the highback 115 is in the reclined position, the user can slide the boot forwardly into the instep support 130. Once the boot is in place, the highback 115 is returned to the upright position and locked in place to secure the boot within the binding.

Figure 2:
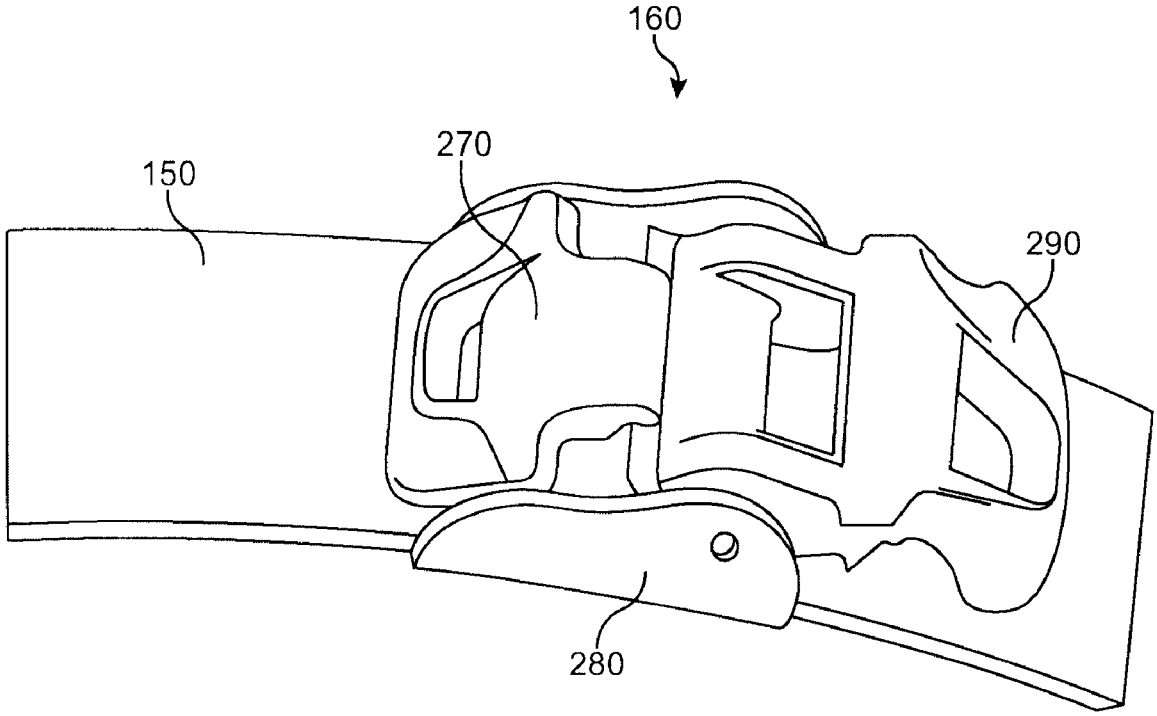
FIG. 2 shows a perspective view of the adjustment mechanism shown in FIG. 1.

FIG. 2 shows a perspective view of an exemplary embodiment of the adjustment mechanism 160 of a snowboard binding 100. The adjustment mechanism 160 is further illustrated in the exploded view of FIG. 3. The adjustment mechanism 160 generally includes a locking member comprised of a back lever 270, a buckle chassis 280, and an actuating member comprised of a front lever 290. The front lever 290 can be actuated to cause the back lever 270 to engage or disengage stepped surfaces on the strap 150 to thereby permit movement or lock movement of the adjustment mechanism 160 along the strap 150, as described in more detail below. The front lever 290 can also be actuated to initiate a ratcheting action that incrementally moves the adjustment mechanism 160 along the strap 150.

Figure 3:
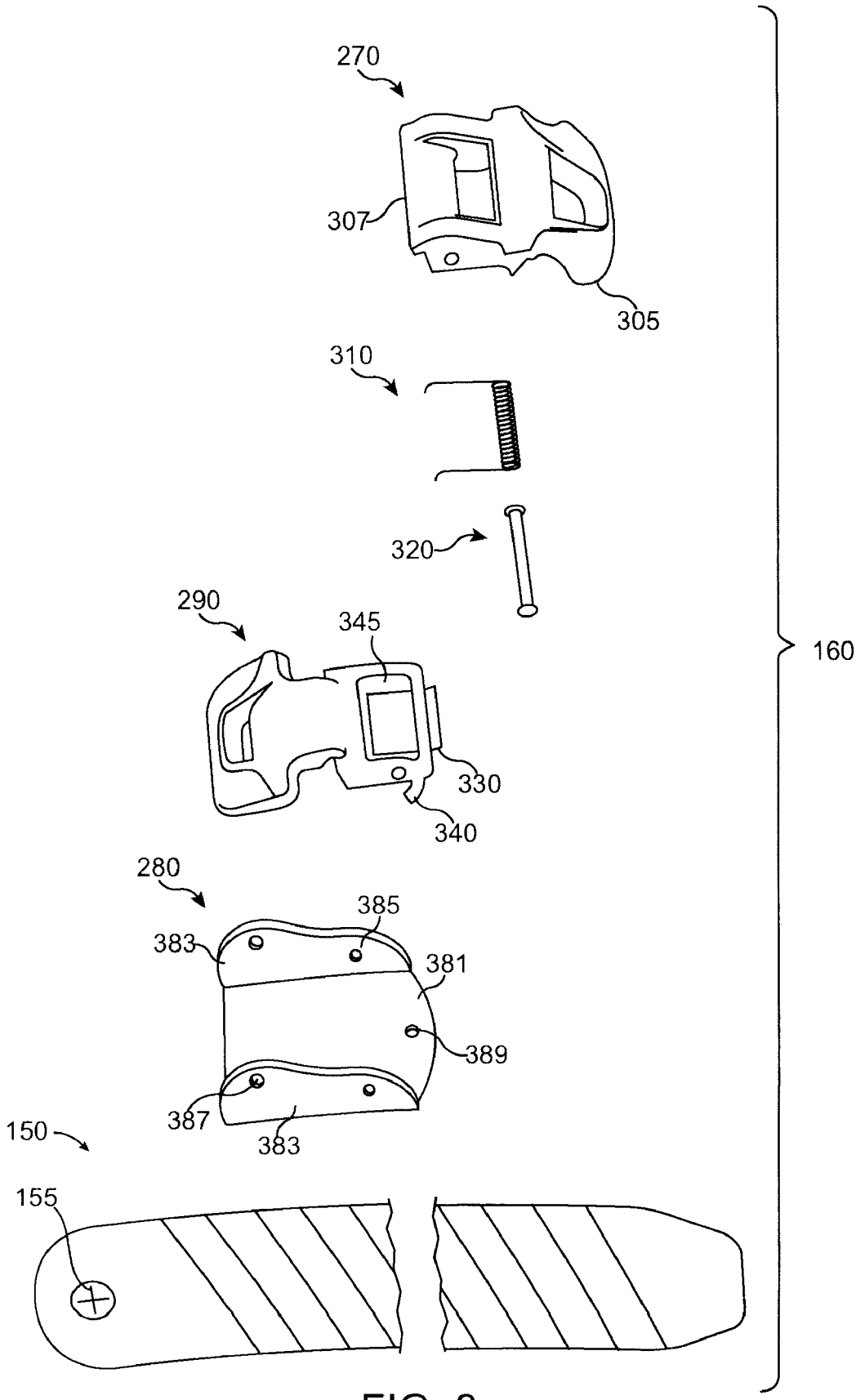
FIG. 3 shows an exploded perspective view of the adjustment mechanism shown in FIG. 2.

Now with respect to the exploded view of FIG. 3, the buckle chassis 280 includes a base 381 on which the strap 150 rests and two guides 383 extending vertically on either side of the strap 150. The buckle chassis 280 also includes apertures 385, 387 and 389. Apertures 385 and 387 are located on each vertical guide 383. A biasing member such as a spring 310 connects the back lever 270 to the buckle chassis 280 through the aperture 385. Aperture 385 is configured to receive the spring 310, which runs through the back lever 270, thereby rotatably fixing the back lever 270 to the buckle chassis 280.

A rod 320 connects the front lever 290 to the buckle chassis 280 through aperture 387. Aperture 387 is configured to receive the rod 320, which runs through the front lever 290, thereby fixing the front lever 290 to the buckle chassis 280. Aperture 389 is located on the base 381 of the buckle chassis 280. Aperture 389 is configured to receive a fixation piece (not shown), such as a bolt or screw, which attaches the buckle chassis 280 and the adjustment mechanism 160 to the instep support 130 (shown in FIG. 1).

The back lever 270 pivots around the spring 310. The spring 310 downwardly biases the back lever 270 toward the strap 150 such that a double pawl 305 engages with the teeth of the strap 150. It will be appreciated that although saw-tooth shaped teeth are disclosed, other strap tooth shapes are also possible, including, for example, generally rectangular teeth and symmetrically triangular teeth. Engagement of the pawl 305 with the teeth of the strap 150 acts to impair forward movement of the buckle chassis 280 along the strap 150 and prevents loosening of the adjustment mechanism 160. The front lever 290 pivots around the rod 320.

The adjustment mechanisms described herein can be fabricated from any suitably sturdy material, including, without limitation, hard polymers, nylon, and metal such as aluminum or steel, to produce a very sturdy and reliable adjustment mechanism.

Figure 4:
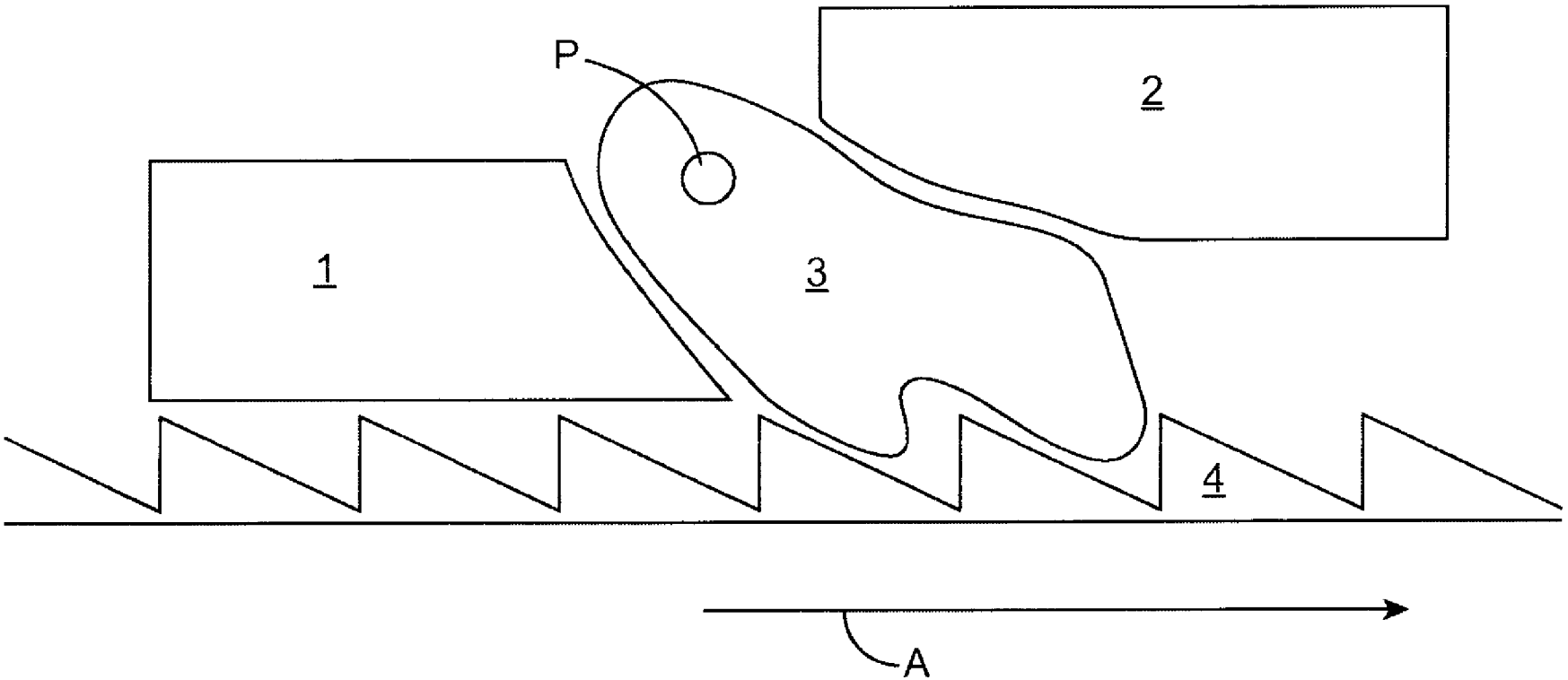
FIG. 4 shows a schematic view of two embodiments of an adjustment mechanism.

FIG. 4 shows a schematic view of two embodiments of the adjustment mechanism. In the first embodiment, a locking member comprised of a lever 3 is engaged with the strap 4 and rotation around its pivot point P is inhibited by locking part 1 preventing downward movement of the lever 3. This results in the pawl of the lever 3 staying engaged with the strap 4 preventing movement in the direction of arrow A. In the second embodiment, rotation of lever 3 around its pivot point P is inhibited by locking part 2 pressing down from the upper surface of the lever similarly preventing movement in the direction of arrow A. Thus, a locking part can be positioned at either one of locations 1 or 2 to prevent the lever 3 from disengaging from the strap 4 and thereby lock the position of the adjustment mechanism along the strap. It should be appreciated that various structural configurations can be used to achieve the mechanism schematically shown in FIG. 4. Some exemplary structural configurations are described herein although it should be appreciated that the disclosure is not limited to those specific configurations.

Figure 5A:
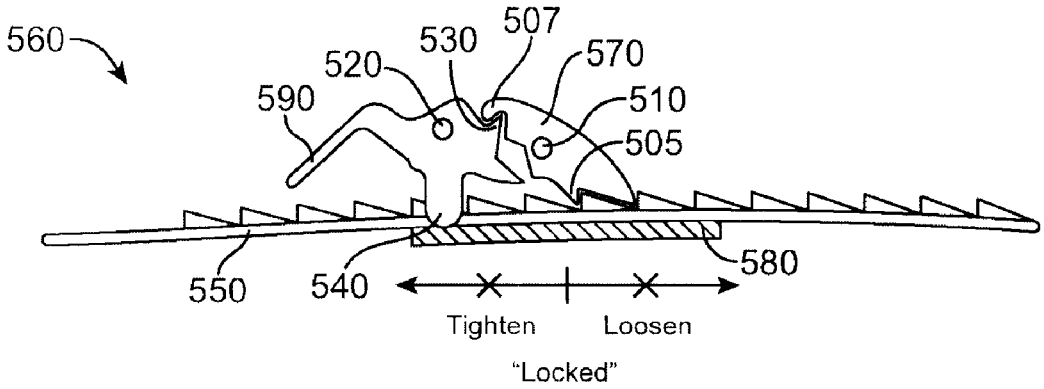
FIGS. 5A-5C show cross-section side views depicting operation of one embodiment of the adjustment mechanism shown in FIG. 2.
Figure 5B:
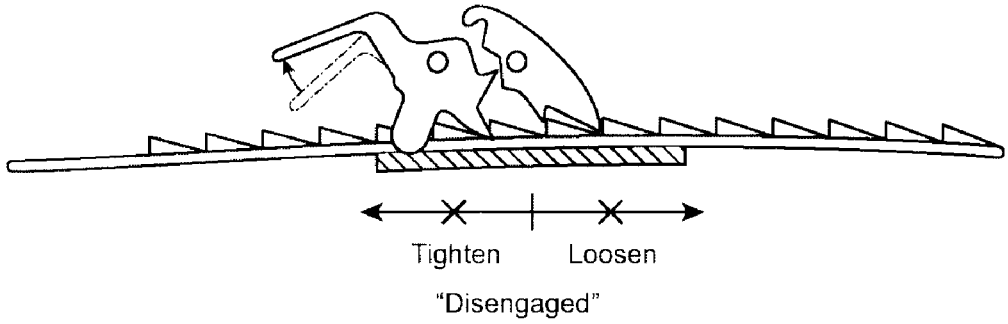
Figure 5C:
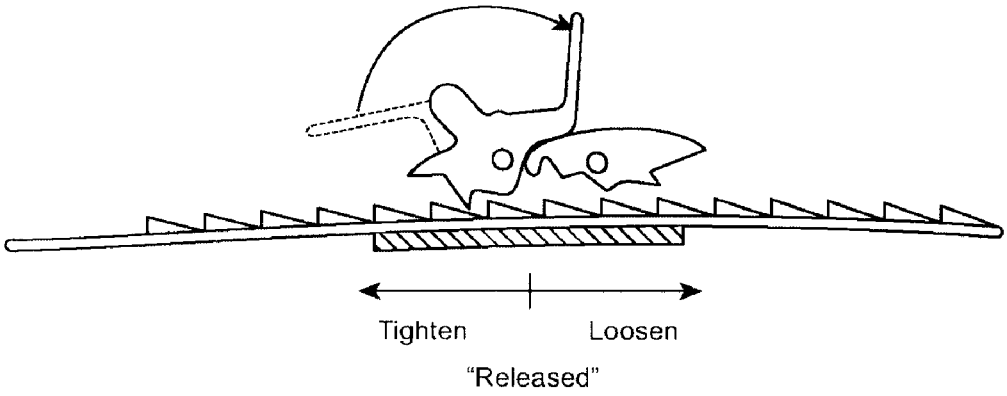

FIGS. 5A-5C shows the operation of one exemplary embodiment of the adjustment mechanism 560. Interaction between the back lever 570 and the front lever 590 within the buckle chassis 580 varies depending upon the position of the adjustment mechanism 560. When in a locked position (FIG. 5A), the front lever 590 is positioned toward the strap 550. The back lever 570 and front lever 590 are in contact with each other by way of the flange 507 of the back lever 570 and the flange 530 of the front lever 590. The back lever 570 is prevented from rotation around its pivot point (spring 510) by way of this interaction between the flange 530 of the front lever 590 and the flange 507 of the back lever 570. The back lever 570 has a double pawl 505 that when in the locked position engages with the strap 550 preventing movement of the buckle chassis 580 in the loosening direction. The front lever 590 also has a pawl 540 that engages with the strap 550 when in the locked position preventing movement in the tightening direction. This is representative of the adjustment mechanism illustrated in embodiment 1 of FIG. 4, although it should be appreciated that mechanisms other than that shown in FIGS. 5A-5C can be used.

When in the disengaged position (FIG. 5B), the front lever 590 is rotated around its pivot point (rod 520) and lifted away from the strap 550. This causes the pawl 540 to move away from the strap 550 and allows for movement of the buckle chassis 580 in the tightening direction only. The double pawl 505 of the back lever 570 is still in position and engaged with the strap 550 preventing movement of the buckle chassis 580 in the loosening direction.

To release the adjustment mechanism 560 from the strap 550 so that the buckle chassis 580 can be moved in both the loosening and tightening directions (FIG. 5C), the front lever 590 is further rotated in an upward direction around its pivot point (rod 520) such that its upper surface presses on an upper surface of the back lever 570. In turn, the back lever 570 rotates around its pivot point (spring 510) and the double pawl 505 moves upward away from the strap 550.

Figure 6A:
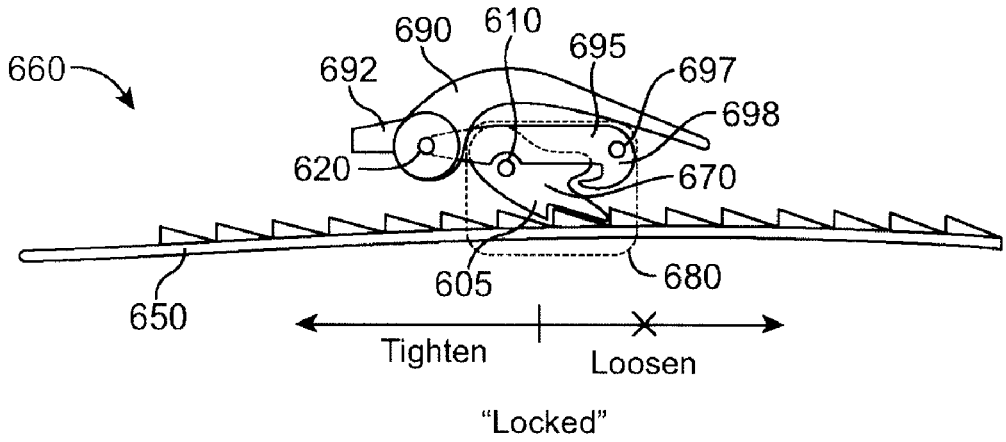
FIGS. 6A-6C show cross-section side views depicting operation of another embodiment of the adjustment mechanism shown in FIG. 2.
Figure 6B:
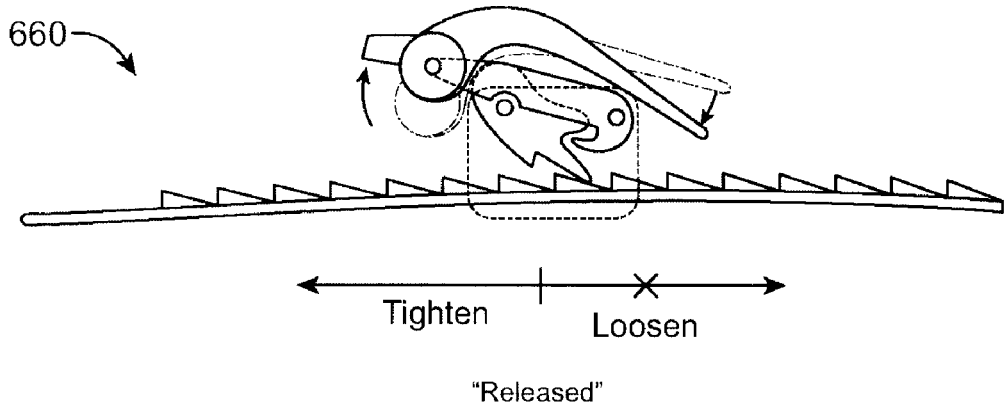
Figure 6C:
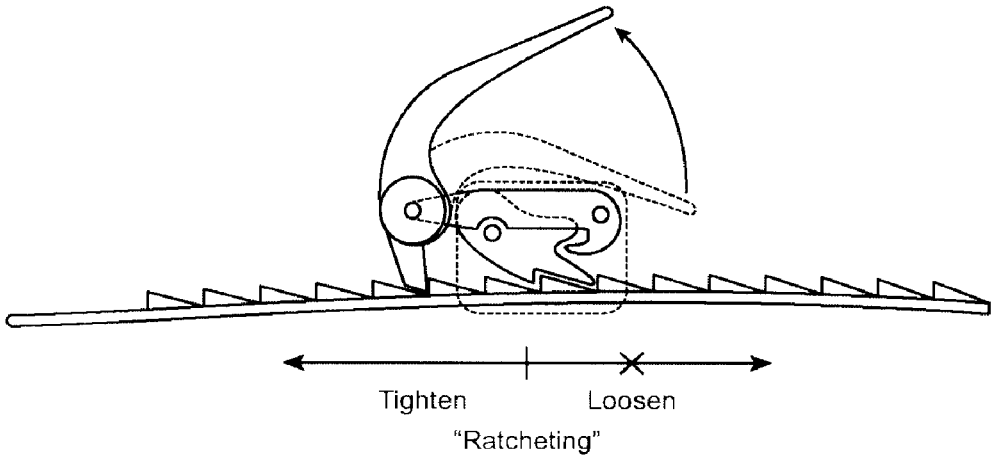

FIGS. 6A-6C show the operation of another embodiment of the adjustment mechanism 660. Interaction between the back lever 670 and the front lever 690 within the buckle chassis 680 varies depending upon the position of the adjustment mechanism 560. When in a locked position (FIG. 6A), the double pawl 605 of the back lever 670 engages with the strap 650 thereby preventing movement of the chassis 680 in the loosening direction.

The back lever 670 and front lever 690 are in contact with each other by way of an exchange lever 695. The exchange lever 695 attaches to the front lever 690 at pivot point 620 and to the chassis 680 at pivot point 697. The exchange lever 695 has a flange 698 that engages with an upper surface of the pawl 605 of the back lever 670. This interaction prevents the back lever 670 from rotating around its pivot point (spring 610) and maintains the pawl 605 in engagement with the strap 650 preventing movement of the chassis 680 in the loosening direction. This is representative of the adjustment mechanism illustrated in the second embodiment of FIG. 4.

To release the adjustment mechanism 660 from the strap 650 so that the buckle chassis 680 can be moved in both the loosening and tightening directions (FIG. 6B), the front lever 690 is pressed downwards toward the strap 650. This results in rotation of the exchange lever 695 around pivot point 697 and upward movement of the forward end of the front lever 690 and exchange lever 695 away from the strap 650. The flange 698 of the exchange lever 695 rotates and pulls up on the pawl 605 of the back lever 670. The movement of the back lever 670 around pivot point 610 results in upward movement of the pawl 605 away from the strap 650 allowing for the chassis 680 to be adjusted in both the loosening and tightening directions.

The adjustment mechanisms described herein can be incrementally tightened by way of a ratcheting mechanism. For example and with respect to FIG. 6C, the front lever 690 is rotated upwardly until the flange 692 at the forward end of the front lever 690 engages a tooth of the strap 650. Further upward rotation of the front lever 690 (not shown) further presses the flange 692 against the tooth of the strap 650 sliding the strap 650 through the chassis 680. This results in movement of the chassis 680 toward the attachment location 155 (shown in FIG. 1) thereby tightening the instep. It is appreciated that the double pawl 605 is pushed upwardly and out of the way by the teeth of the strap 650. It is also appreciated that because the pawl 605 is in the lower position and engaged with the teeth of the strap 650, that movement of the chassis 680 in the loosening direction is thereby prevented. The user can then repeat the tightening stroke until the desired strap tension is achieved. At this point, the front lever 690 can be returned to the locked position.

Although embodiments of various methods and devices are described herein in detail with reference to certain versions, it should be appreciated that other versions, embodiments, methods of use, and combinations thereof are also possible. Therefore, the spirit and scope of the snowboard binding should not be limited to the description of the embodiments contained herein.

What is claimed:

1. A binding for coupling a boot to a sport board, comprising:

a base plate;

an instep support;

at least one fixation strap that couples the base plate to the instep support, wherein the strap comprises a plurality of teeth; and an adjustment mechanism coupled to the fixation strap and laterally moveable along the fixation strap, the adjustment mechanism comprising:

a front lever rotatable about a first pivot axis in a first and a second direction, the front lever comprising a trailing end having a flange; and a back lever rotatable about a second pivot axis in the first and the second directions, the back lever comprising a leading end configured to engage the flange and a trailing end having a pawl spring-biased to be rotated about the second pivot axis in the first direction to engage the teeth of the strap, wherein the adjustment mechanism is adjustable to a bi-directional locked position, comprising:

the pawl engaged with the teeth of the strap preventing lateral movement of the adjustment mechanism in a loosening direction, and the flange of the front lever in locked engagement with the leading end of the back lever preventing rotation of the back lever about the second pivot axis in the second direction and lateral movement of the adjustment mechanism in a tightening direction.

2. A binding as in claim 1, wherein the adjustment mechanism is fixed to the instep support or the base plate.

3. A binding as in claim 1, wherein the instep support moves along the strap.

4. A binding as in claim 1, wherein the adjustment mechanism is adjustable to a ratcheting position by rotating the front lever about the first pivot axis to incrementally move the adjustment mechanism in the tightening direction and the instep support toward the base plate.

5. A binding as in claim 1, wherein the adjustment mechanism is adjustable to a bi-directional released position wherein the front lever is rotated about the first pivot axis in the first direction such that the front lever urges the back lever to rotate about the second pivot axis in the second direction to move the pawl out of engagement with the teeth such that the adjustment mechanism is laterally moveable along the strap in both the tightening and loosening directions.

6. A binding as in claim 1, further comprising a highback that extends upwardly from the base plate, the highback adapted to provide support to a rear region of a user's foot or leg.

7. A binding as in claim 6, wherein the highback reclines relative to the base plate.

8. A binding as in claim 1, wherein the adjustment mechanism is adjustable to a uni-directional locked position comprising the front lever rotated about the first pivot axis in the first direction such that the leading end of the back lever is released from locked engagement allowing rotation of the back lever about the second pivot axis in the second direction and allowing lateral movement of the adjustment mechanism in the tightening direction while the pawl of the back lever is spring-biased to rotate about the second pivot axis in the first direction to engage the teeth of the strap preventing lateral movement of the adjustment mechanism in the loosening direction.

9. A binding as in claim 1, wherein the binding is a snowboard binding.

* * * * *